US011097553B2

(12) United States Patent
Kurokawa

(10) Patent No.: US 11,097,553 B2
(45) Date of Patent: Aug. 24, 2021

(54) IMAGE FORMING APPARATUS

(71) Applicant: KYOCERA Document Solutions Inc., Osaka (JP)

(72) Inventor: Yuichiro Kurokawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/814,495

(22) Filed: Mar. 10, 2020

(65) Prior Publication Data

US 2020/0307248 A1 Oct. 1, 2020

(30) Foreign Application Priority Data

Mar. 27, 2019 (JP) ..... JP2019-060985

(51) Int. Cl.
*B41J 2/21* (2006.01)
*B41J 11/00* (2006.01)

(52) U.S. Cl.
CPC ..... *B41J 2/2146* (2013.01); *B41J 11/007* (2013.01); *B41J 11/0045* (2013.01)

(58) Field of Classification Search
CPC .... B41J 2/2146; B41J 11/007; B41J 11/0045; B41J 2/2135; G03G 15/6529; G03G 15/6502; G03G 15/6567; G03G 15/70
See application file for complete search history.

(56) References Cited

U.S. PATENT DOCUMENTS

2003/0043227 A1* 3/2003 Horikoshi ..... B41J 2/0458 347/37

FOREIGN PATENT DOCUMENTS

JP 2005-138489 A 6/2005

* cited by examiner

*Primary Examiner* — Huan H Tran
(74) *Attorney, Agent, or Firm* — Stein IP, LLC

(57) ABSTRACT

A control portion sets, as a head line of test mask data, such a read pixel line of a plurality of read pixel lines of read data obtained by a reading portion by performing reading, the plurality of read pixel lines being orthogonal to the sheet conveyance direction, as is located at a position upstream of a read pixel line of the plurality of read pixel lines as is read at a time when a detection portion detects a leading end of the sheet, by a number of lines calculated by adding an initial number of offset lines to a reference number of lines, and sets, as a non mask region, a sheet read region of the test mask data, and replaces, with white pixels, pixels outside such a region of test image data as corresponds to the non mask region.

6 Claims, 13 Drawing Sheets

FIG.5

| IMAGE DATA PRINT PIXEL LINE NUMBER VALUE | COUNT VALUE | BIT SHIFT → | COUNT VALUE ÷ 65536 | EXTRACT INTEGER PART → | INTEGER PART |
|---|---|---|---|---|---|
| 0 | 0 | | 0 | | 0 |
| 1 | 22754 | | 0.347198486 | | 0 |
| 2 | 45508 | | 0.694396973 | | 0 |
| 3 | 68262 | | 1.041595459 | | 1 |
| 4 | 91016 | | 1.388793945 | | 1 |
| 5 | 113770 | | 1.735992432 | | 1 |
| 6 | 136524 | | 2.083190918 | | 2 |
| 7 | 159278 | | 2.430389404 | | 2 |
| 8 | 182032 | | 2.777587891 | | 2 |
| 9 | 204786 | | 3.124786377 | | 3 |
| 10 | 227540 | | 3.471984863 | | 3 |
| 11 | 250294 | | 3.81918335 | | 3 |
| 12 | 273048 | | 4.166381836 | | 4 |
| 13 | 295802 | | 4.513580322 | | 4 |
| 14 | 318556 | | 4.860778809 | | 4 |
| 15 | 341310 | | 5.207977295 | | 5 |
| 16 | 364064 | | 5.555075781 | | 5 |
| 17 | 386818 | | 5.902374268 | | 5 |
| 18 | 409572 | | 6.249572754 | | 6 |
| 19 | 432326 | | 6.59677124 | | 6 |
| 20 | 455080 | | 6.943969727 | | 6 |
| 21 | 477834 | | 7.291168213 | | 7 |
| 22 | 500588 | | 7.638366699 | | 7 |
| 23 | 523342 | | 7.985565186 | | 7 |
| 24 | 546096 | | 8.332763672 | | 8 |
| 25 | 568850 | | 8.679962158 | | 8 |
| 26 | 591604 | | 9.027160645 | | 9 |
| 27 | 614358 | | 9.374359131 | | 9 |
| 28 | 637112 | | 9.721557617 | | 9 |
| 29 | 659866 | | 10.0687561 | | 10 |
| 30 | 682620 | | 10.41595459 | | 10 |
| 31 | 705374 | | 10.76315308 | | 10 |
| 32 | 728128 | | 11.11035156 | | 11 |
| ⋮ | ⋮ | | ⋮ | | ⋮ |

FIG.15

| SCALE VALUE | INTERVAL VALUE (dot) | LATERAL LINE PITCH (dot) |
|---|---|---|
| 1.5 | 35 | — |
| 1.4 | 33 | 2 |
| 1.3 | 31 | 2 |
| 1.2 | 29 | 2 |
| 1.1 | 26 | 3 |
| 1.0 | 24 | 2 |
| 0.9 | 21 | 3 |
| 0.8 | 19 | 2 |
| 0.7 | 17 | 2 |
| 0.6 | 14 | 3 |
| 0.5 | 12 | 2 |
| 0.4 | 10 | 2 |
| 0.3 | 7 | 3 |
| 0.2 | 5 | 2 |
| 0.1 | 2 | 3 |
| 0 | 0 | 2 |
| -0.1 | -2 | 2 |
| -0.2 | -5 | 3 |
| -0.3 | -7 | 2 |
| -0.4 | -10 | 3 |
| -0.5 | -12 | 2 |
| -0.6 | -14 | 2 |
| -0.7 | -17 | 3 |
| -0.8 | -19 | 2 |
| -0.9 | -21 | 2 |
| -1.0 | -24 | 3 |
| -1.1 | -26 | 2 |
| -1.2 | -29 | 3 |
| -1.3 | -31 | 2 |
| -1.4 | -33 | 2 |
| -1.5 | -35 | 2 |

IMAGE FORMING APPARATUS

INCORPORATION BY REFERENCE

This application is based upon and claims the benefit of priority from the corresponding Japanese Patent Application No. 2019-060985 filed on Mar. 27, 2019, the entire contents of which are incorporated herein by reference.

BACKGROUND

The present disclosure relates to an image forming apparatus which prints an image on a sheet.

An image forming apparatus such as an inkjet printer is provided with an ink head. The ink head prints an image on a sheet by ejecting ink to the sheet under conveyance.

A conventional inkjet printer is provided with a reading portion (for example, an image sensor) which performs reading at a reading position which is on an upstream side of a printing position in a sheet conveyance direction. The reading portion detects two opposite ends of the sheet under conveyance in a direction (a left-right direction) orthogonal to the sheet conveyance direction.

Conventionally, in a case where the sheet under conveyance is displaced in the left-right direction, an image in image data to be used for printing is shifted in the left-right direction in accordance with the left-right displacement of the sheet. This helps reduce the occurrence of ink ejection to a region outside the sheet under conveyance.

SUMMARY

According to an aspect of the present disclosure, an image forming apparatus includes a printing portion, a reading portion, a detecting portion, a control portion, and a storage portion. The printing portion performs printing on a sheet under conveyance on a one-by-one basis of lines orthogonal to a sheet conveyance direction. The reading portion reads, at a reading position on an upstream side of a printing position of the printing portion in the sheet conveyance direction, the sheet under conveyance on a one-by-one basis of lines orthogonal to the sheet conveyance direction. The detection portion detects a leading end of the sheet under conveyance at a detection position between the printing position and the reading position. The control portion controls the printing portion. The storage portion stores therein a reference number of lines. which is a number of lines to be read in accordance with a design distance between the reading position and the detection position in the sheet conveyance direction. Here, the storage portion stores therein an initial number of offset lines, which is a number of lines to be read determined in advance as an initial value of a number of test offset lines. When making the printing portion perform test printing based on test image data including a test image, the control portion sets, as a head line of test mask data, such a read pixel line of a plurality of read pixel lines of read data obtained by the reading portion by performing reading, the plurality of read pixel lines being orthogonal to the sheet conveyance direction, as is located at a position upstream of a detection-time line, the detection-time line being such a read pixel line of the plurality of read pixel lines as is read at a time at which the detection portion detects a leading end of the sheet, by a number of lines calculated by adding the initial number of offset lines to the reference number of lines. The control portion sets, as a non mask region, a sheet read region of the test mask data, the sheet read region being obtained by reading the sheet. The control portion performs mask processing with respect to the test image data based on the test mask data to thereby replace, with white pixels, pixels outside such a region of the test image data as corresponds to the non mask region of the test mask data.

BRIEF DESCRIPTION OF THE DRAWINGS

FIG. 5 is a diagram for illustrating assignment processing performed by the control portion of the inkjet printer according to the embodiment of the present disclosure;

FIG. 15 is a diagram for illustrating adjustment information stored in a storage portion of the inkjet printer according to the embodiment of the present disclosure.

DETAILED DESCRIPTION

Hereinafter, an image forming apparatus according to an embodiment of the present disclosure will be described by taking an inkjet printer as an example of the image forming apparatus.

Figure 1:
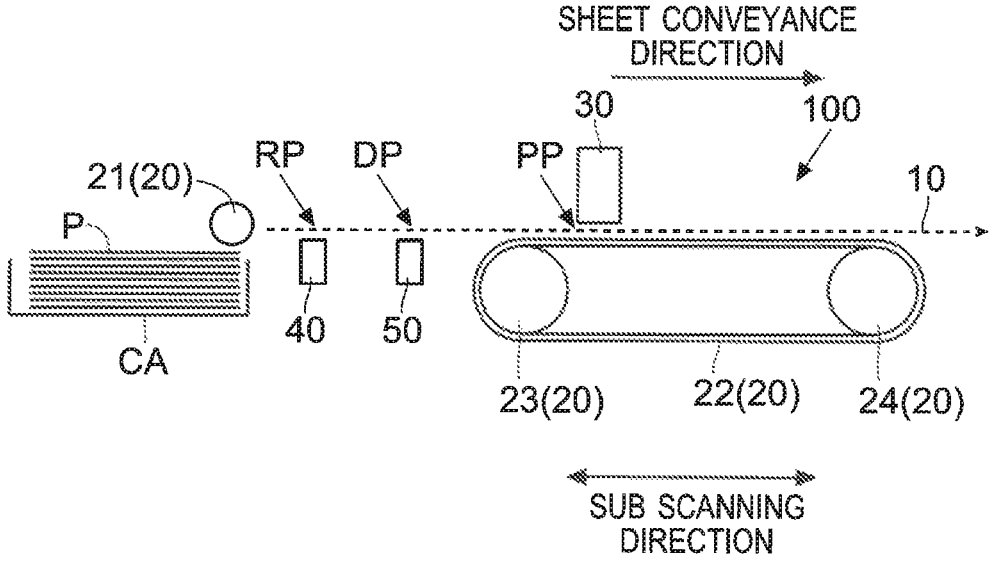
FIG. 1 is a diagram schematically showing a configuration of an inkjet printer according to an embodiment of the present disclosure.

Configuration of Inkjet Printer: As shown in FIG. 1, an inkjet printer 100 of the present embodiment includes a sheet conveyance path 10. In FIG. 1, the sheet conveyance path 10 is indicated by a broken-line arrow. The inkjet printer 100 conveys a sheet P along the sheet conveyance path 10. The inkjet printer 100 prints an image on the sheet P while the sheet P is being conveyed along the sheet conveyance path 10. Sheet P to be used for printing are accommodated in a sheet cassette CA.

Here, a conveyance direction of a sheet P (hereinafter referred to as the sheet conveyance direction) is a direction that is parallel to a sub scanning direction (more specifically, a direction toward one side of the sub scanning direction), the sub scanning direction being orthogonal to a main scanning direction of printing. In FIG. 1, the main scanning direction is a direction perpendicular to a surface of the sheet on which FIG. 1 is drawn.

The inkjet printer 100 further includes a conveyance portion 20. The conveyance portion 20 includes a pick-up roller 21. The pick-up roller 21 contacts a sheet P accommodated in the sheet cassette CA, and rotates. Thereby, the sheet P is pulled out of the sheet cassette CA to be fed into the sheet conveyance path 10. Although not shown, the sheet conveyance path 10 is provided with a plurality of conveyance roller pairs. The sheet P fed into the sheet conveyance path 10 is then conveyed by the plurality of conveyance roller pairs.

The conveyance portion 20 includes a conveyance belt 22. The conveyance belt 22 is an endless belt. The conveyance belt 22 is tensioned by a drive roller 23 and a driven roller 24. The drive roller 23 operates (rotates) to make the conveyance belt 22 rotate.

The sheet P fed from the sheet cassette CA arrives on the conveyance belt 22. At this time, the conveyance belt 22 is rotating. Thereby, the sheet P on the conveyance belt 22 is conveyed. Although not shown, in the conveyance belt 22, there are formed a plurality of suction holes to penetrate through the conveyance belt 22 in its thickness direction. Inside the conveyance belt 22, there is disposed a suction unit. The suction unit generates negative pressure to attract the sheet P toward the conveyance belt 22.

The inkjet printer 100 further includes a printing portion 30. The printing portion 30 includes an ink head 31 (see FIG. 2). In the following description, the position of the ink head 31 in the sheet conveyance direction is a printing position PP of the printing portion 30.

The ink head 31 has a plurality of nozzles 32 (see FIG. 2) through which ink is ejected. The plurality of nozzles 32 are arrayed in the main scanning direction. Although not shown, the plurality of nozzles 32 are each provided with a piezoelectric element. By applying voltage to a piezoelectric element, a nozzle 32 corresponding to the piezoelectric element to which voltage is applied operates (that is, ink is ejected from the nozzle 32).

The ink head 31 is arranged above the conveyance belt 22 such that a nozzle surface thereof where the nozzles 32 are formed faces an upper surface (a sheet placing surface on which the sheet P is placed) of the conveyance belt 22. The printing portion 30 ejects ink onto a sheet P (the sheet P under conveyance) on the conveyance belt 22, and thereby prints an image on the sheet P under conveyance on a one-by-one basis of lines orthogonal to the sheet conveyance direction. The printing resolution of the printing portion 30 in the sub scanning direction is, for example, 600 dpi. That is, under the printing resolution of the printing portion 30, a one-dot width (a one-line width) is 0.04233 mm.

The inkjet printer 100 further includes a reading portion 40. The reading portion 40 reads a reading target by a CIS (Contact Image Sensor) method. The reading portion 40 includes an image sensor 41 (see FIG. 2). The image sensor 41 includes light receiving elements arrayed in a direction orthogonal to the sheet conveyance direction. That is, a main scanning direction of the reading performed by the reading portion 40 is identical to the main scanning direction of the printing performed by the printing portion 30.

The reading portion 40 performs reading at a predetermined reading position RP, which is a position in the sheet conveyance path 10 and is on an upstream of the printing position PP of the printing portion 30 in the sheet conveyance direction. The reading portion 40, at the reading position RP, reads the sheet P under conveyance on a one-by-one basis of lines orthogonal to the sheet conveyance direction. The reading resolution of the reading portion 40 in the sub scanning direction is lower than the printing resolution of the printing portion 30 in the sub scanning direction. The printing resolution is neither an integral multiple nor a reciprocal multiple of the reading resolution. For example, a one-dot width (a one-line width) under the reading resolution is 0.12193 mm.

The inkjet printer 100 further includes a detection portion 50. The detection portion 50 includes a reflective optical sensor. The detection portion 50 performs detection at a predetermined detection position DP, which is a position in the sheet conveyance path 10 and is between the printing position PP of the printing portion 30 and the reading position RP of the reading portion 40.

Figure 2:
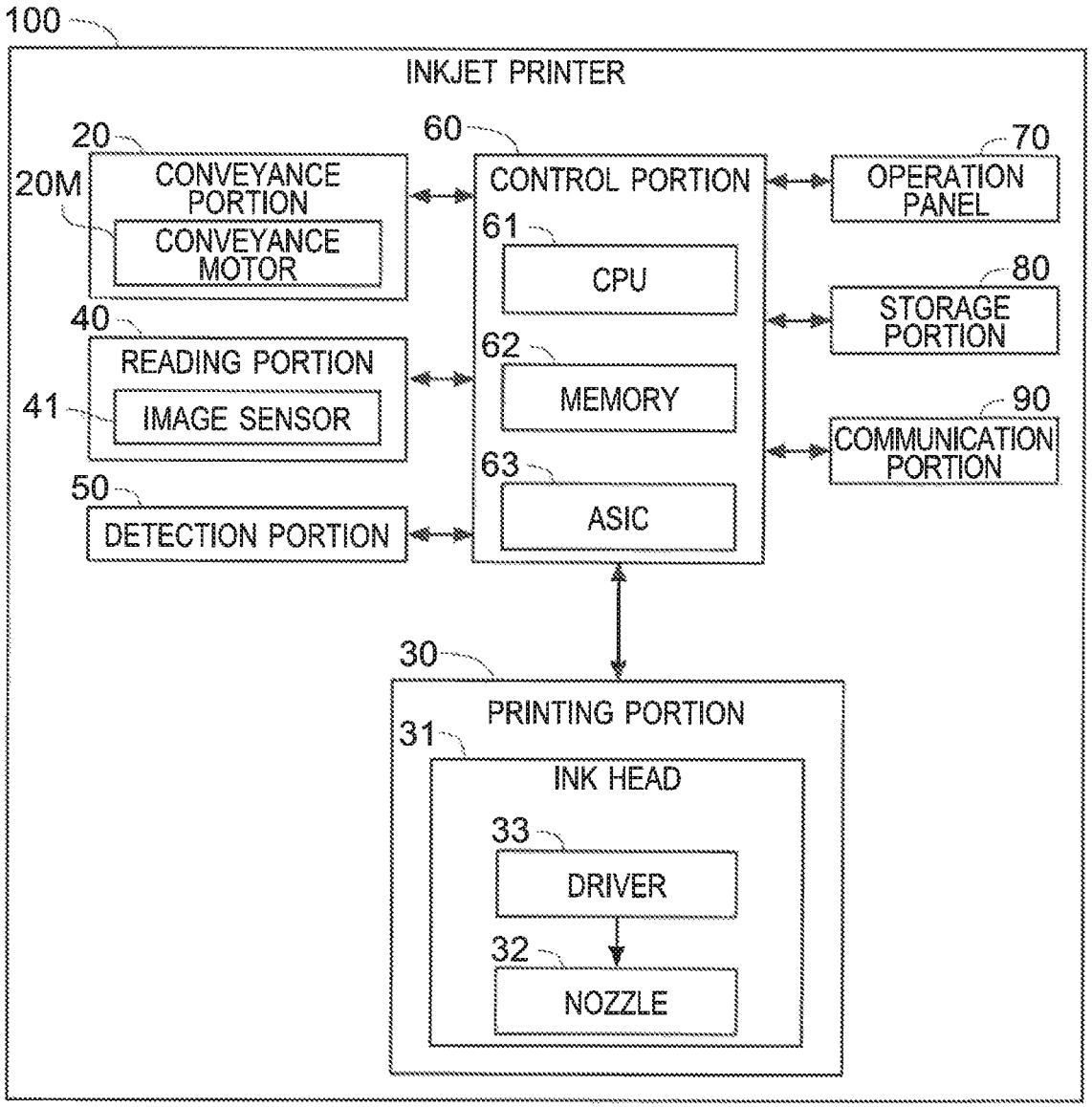
FIG. 2 is a block diagram showing a configuration of the inkjet printer according to the embodiment of the present disclosure.

The detection portion 50 emits light toward the detection position DR When the sheet P under conveyance has not reached the detection position DP yet, the light emitted from the detection portion 50 is not reflected. On the other hand, when an end (leading end) of the sheet P under conveyance on the downstream side in the sheet conveyance direction reaches the detection position DP, the light emitted from the detection portion 50 is reflected by the sheet P, and the detection portion 50 receives the reflection light coming from the sheet P. When receiving the reflection light, the detection portion 50 detects that the downstream-side end of the sheet P under conveyance in the sheet conveyance direction has reached the detection position DR As shown in FIG. 2, the inkjet printer 100 further includes a control portion 60. The control portion 60 includes a CPU 61, a memory 62, and an ASIC 63. The CPU 61 operates based on a control program and control data, and controls the inkjet printer 100. The memory 62 stores therein the control program and the control data. The ASIC 63 performs particular processing including image processing (including mask processing, which will be described later).

The control portion 60 is connected to a conveyance motor 20M which rotates various rollers (such as the pick-up roller 21, the drive roller 23 of the conveyance belt 22, a plurality of unillustrated conveyance roller pairs, etc.) of the conveyance portion 20. The control portion 60 controls the conveyance motor 20M, and rotates the various rollers of the conveyance portion 20. FIG. 2 shows only one conveyance motor 20M, but this is not meant to limit the number of the conveyance motor 20M to be provided. For example, the pick-up roller 21 and the drive roller 23 may respectively be driven by different motors. Further, the plurality of conveyance roller pairs may be divided into some groups based on their respective locations.

The printing portion 30 further includes a driver 33. The driver 33 is a circuit that controls ink ejection. The driver 33 performs ON-OFF control with respect to voltage application to each piezoelectric element of the ink head 31 (that is, the driver 33 controls ink ejection).

The driver 33 is connected to the control portion 60. The control portion 60 feeds the driver 33, based on image data of an image to be printed, on a line-by-line basis, with an ejection control signal indicating which ones of the nozzles 32 should eject ink. The driver 33 applies voltage to the piezoelectric elements of the nozzles 32 that should eject ink. Thereby, ink is ejected from the nozzles 32 that correspond to the piezoelectric elements to which voltage has been applied. Further, the control portion 60 controls the conveyance motor 20M such that the sheet P proceeds by the one-line (one-dot) width each time ink is ejected. Here, the driver 33 does not apply voltage to the piezoelectric elements that correspond to the nozzles 32 that should not eject ink.

The reading portion 40 is connected to the control portion 60. The control portion 60 controls the reading operation of the reading portion 40. For example, the control portion 60 makes the reading portion 40 perform reading from the start till the end of the printing. The control portion 60 acquires read data obtained by the reading performed by the reading portion 40. The control portion 60, based on the read data, generates mask data M and test mask data TM, which will be described later.

The detection portion 50 is connected to the control portion 60. The control portion 60 detects an output value of the detection portion 50. The control portion 60, based on the output value of the detection portion 50, judges whether or not the sheet P is present at the detection position DP. Further, each time the conveyance portion 20 feeds a sheet P, the control portion 60 judges, based on the output value of the detection portion 50, whether or not the downstream-side end of the fed sheet P (the sheet P under conveyance) has reached the detection position DP. Note that, in the following description, the downstream-side end of the sheet P in the sheet conveyance direction may be referred to also as the leading end of the sheet P. On the other hand, the upstream-side end of the sheet P in the sheet conveyance direction may also be referred to as the rear end of the sheet P.

After the conveyance portion 20 feeds the sheet P, the control portion 60 counts time elapsed from arrival of the leading end of the sheet P under conveyance at the detection position DP. The control portion 60, based on the elapsed time, measures timing of the leading end of the sheet P under conveyance reaching the printing position PP. In other words, the control portion 60, based on the elapsed time, measures timing of starting printing performed by the printing portion 30.

The inkjet printer 100 further includes an operation panel 70. The operation panel 70 includes a touch screen. The operation panel 70 is also provided with hardware buttons. The touch screen displays a screen and accepts an input operation from a user. An operation of touching the touch screen is accepted as an input operation.

The operation panel 70 is connected to the control portion 60. The control portion 60 controls the display operation of the operation panel 70 (the touch screen). The control portion 60 detects an operation performed with respect to the operation panel 70. The control portion 60 recognizes an input value inputted through the input operation with respect to the operation panel 70.

The inkjet printer 100 further includes a storage portion 80. The storage portion 80 includes non-volatile storage devices (a ROM, an HDD, etc.). The storage portion 80 is connected to the control portion 60. The control portion 60 reads data from the storage portion 80 and writes data on the storage portion 80.

For example, in the storage portion 80, there is stored test image data, which is image data that includes a test image G. The test image G will be described later in detail.

The inkjet printer 100 further includes a communication portion 90. The communication portion 90 includes a communication circuit, a communication memory, communication connector, etc. The communication portion 90 is connected to an external device via a network such as LAN. For example, the external device is a personal computer used by the user.

From the external device to the inkjet printer 100, print data is transmitted which is, for example, PDL data generated in the external device. When the communication portion 90 has received the print data, the control portion 60 judges that a request to execute printing has been received. The control portion 60 generates image data based on the print data that the communication portion 90 has received.

Figure 3:
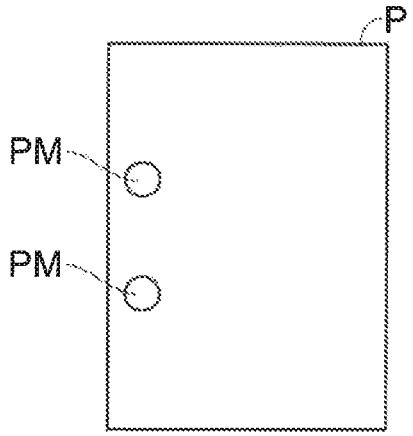
FIG. 3 is a diagram showing an example of a sheet used in normal printing performed by the inkjet printer according to the embodiment of the present disclosure.

Mask Data: In printing performed by the inkjet printer 100, as shown in FIG. 3, there can be a case where a sheet P used in the printing has a missing part PM. For example, the missing part PM is a part where a punch hole is formed.

In the case where a sheet P having a missing part PM is used, if ink is ejected to the missing part PM, the ink will adhere to such part of the conveyance belt 22 as overlaps with the missing part PM. That is, the conveyance belt 22 becomes polluted. If ink adheres to the conveyance belt 22, if, thereafter, another sheet P comes into contact with the conveyance belt 22, the another sheet P can become polluted with the ink on the conveyance belt 22, and this is inconvenient.

To prevent such inconvenience, the control portion 60 generates the mask data M (see FIG. 4) based on the read data obtained through the reading performed by the reading portion 40, and performs mask processing with respect to image data to be used for printing. The control portion 60 sets a sheet read region M1 of the mask data M as a non mask region, the sheet read region M1 having been obtained by reading the sheet P. The sheet read region M1 is a region where ink ejection is allowed (a region where printing is allowed). On the other hand, an outside of the sheet read region M1 (a non mask region) is a mask region where ink ejection is prohibited (a region where printing is prohibited). A detailed description will be given below.

Figure 4:
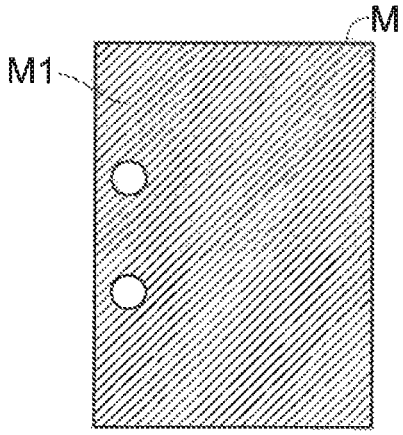
FIG. 4 is a diagram showing an example of mask data generated by a control portion of the inkjet printer according to the embodiment of the present disclosure.

Here, in FIG. 4, the sheet read region M1 is hatched. Here, FIG. 4 is a conceptual diagram of the mask data M corresponding to the sheet P shown in FIG. 3. Missing parts PM exist in the sheet P, and thus, of the mask data M, regions corresponding to the missing parts PM are each a mask region.

The control portion 60 recognizes, of a plurality of read pixel lines in the read data, each extending in the main scanning direction of the read data (a direction orthogonal to the sheet conveyance direction), a read pixel line (hereinafter referred to as the detection-time line) read at a time of the detection portion 50 detecting the leading end of the sheet P under conveyance. Then, the control portion 60 sets, as a head line of the mask data M, such a read pixel line of the plurality of read pixel lines of the read data as is located at a position upstream of the detection-time line in the sheet conveyance direction by a reference number of lines, which is the number of read lines in accordance with a designed distance between the reading position RP and the detection portion DP in the sheet conveyance direction. The reference number of lines is stored in the storage portion 80 in advance.

Then, the control portion 60, based on the mask data M, performs the mask processing with respect to the image data to be used for printing. The control portion 60 performs, as the mask processing, processing of replacing, with white pixels, such ones of the plurality of pixels of the image data as exist outside the region corresponding to the sheet read region M1 (a non mask region) of the mask data M. For example, in a case where the image data is 8-bit 256-tone data (image data where "0" is white and "255" is black), of the plurality pixels of the image data, those existing outside the region corresponding to the sheet read region M1 of the mask data M each have a pixel value of 0.

Here, the printing resolution of the printing portion 30 in the sub scanning direction is different from the reading resolution of the reading portion 40 in the sub scanning direction (the printing resolution is neither an integral multiple nor a reciprocal multiple of the reading resolution). Thus, the control portion 60 performs assignment processing of making settings regarding what number read pixel line of the read pixel lines of the mask data M should be assigned to each of the plurality of print pixel lines in the image data to be used for printing, the plurality of print pixel lines each extending in the main scanning direction (a direction orthogonal to the sheet conveyance direction).

When performing the assignment processing. the control portion 60 recognizes a reference ratio, which is a ratio of the one-dot width under the printing resolution of the printing portion 30 to the one-dot width under the reading resolution under the reading portion 40. The reference ratio is stored in the storage portion 80 in advance. In a case where the one-dot width under the printing resolution is 0.04233 mm, and the one-dot width under the reading resolution is 0.12193 mm, the value calculated by dividing the one-dot width under the printing resolution by the one-dot width under the reading resolution is approximately 0.3472. In the following description, it is assumed that the reference ratio is 0.3472.

The control portion 60 recognizes a read pixel line number value of each of the plurality of read pixel lines of the mask data M. The read pixel line number value is a value (integer) indicating what number line the read pixel line corresponding to the read pixel line number value is from the head line of the mask data M. Note that since the reading resolution is lower than the printing resolution, the mask data M has a smaller number of lines than print image data does.

Also, the control portion 60 obtains the integer part of a value calculated by multiplying, by the reference ratio, a print pixel line number value corresponding to each of the plurality of print pixel lines of the image data to be used for printing. The print pixel line number value is a value (integer) indicating what number line the print pixel line corresponding to the print pixel line number value is from the head print pixel line of the print image data in the sub scanning direction.

Then, the control portion 60, with respect to each of the plurality of print pixel lines of the image data to be used for printing, assigns a read pixel line having a read pixel line number value equal to the obtained integer part, and performs the mask processing. Specifically, with respect to each of the plurality of print pixel lines, the control portion 60 replaces, with white pixels, pixels outside a region corresponding to the sheet read region M1 (non mask region) of the assigned read pixel line.

The control portion 60 performs a bit shift when obtaining the integer part of each of the plurality of print pixel lines of the image data to be used for printing. Though there is no particular limitation, the bit shift that is performed here is a 16-bit shift. In this case, based on a value (about 22754) calculated by multiplying 65536 ($=2^{16}$) by 0.3472 (the reference ratio), a reference incremental value is determined in advance. That is, the reference incremental value is an incremental value proportional to the reference ratio. For example, the reference incremental value is set to 22754. The reference incremental value is stored in the storage portion 80 in advance.

When performing the bit shift, as shown in FIG. 5, the control portion 60 sequentially counts the plurality of print pixel lines in the image data to be used for printing, and increments a count value based on the reference incremental value. The control portion 60 increases a count value by 22754. That is, the control portion 60 multiplies the print pixel line number value of each of the plurality of print pixel lines of the image data by the reference incremental value. For example, the control portion 60 performs counting according to a horizontal synchronization signal HSYNC.

The control portion 60, each time it increments a count value, divides the count value (the product of multiplication of the print pixel line number value by the reference incremental value) by $2^{16}$, and extracts the integer part of the thereby calculated value. Each time it increments a count value, the control portion 60 stores, in the storage portion 80, the print pixel line number value of the print pixel line that is the target of each counting and the then extracted integer part in correspondence with each other. Then, the control portion 60 assigns each of the plurality of print pixel lines with a read pixel line that has a read pixel line number value of the same value as the corresponding integer part.

Here, ideally, the read pixel line at the time of the reading portion 40 reading the leading end of the sheet P is set as the head line of the mask data M. However, if, for example, the reading position RP is displaced from its design position, a read pixel line displaced from the read pixel line at the time of the reading portion 40 reading the leading end of the sheet P is set as the head line of the mask data M. As a result, the position of such a region of the image data to be used for printing as corresponds to the sheet read region M1 of the mask data M is displaced in the sheet conveyance direction.

To reduce occurrence of such inconvenience, the inkjet printer 100 is equipped with a displacement adjustment function for adjustment such that, on the image data to be used for printing, the position of the region corresponding to the sheet read region M1 of the mask data M does not become displaced in the sheet conveyance direction. A detailed description will be given below.

Displacement Adjustment Function: The operation panel 70 accepts ON/OFF setting of the displacement adjustment function from an adjusting person. When the displacement adjustment function is set effective, the operation panel 70 accepts, from the adjusting person, instructions to execute test printing. When the operation panel 70 accepts the instruction to execute test printing, the control portion 60 makes the printing portion 30 perform the test printing.

The printing portion 30 performs printing on a sheet P based on the test image data, which is image data that includes the test image G, of which the printing position on the sheet P is determined in advance. The test image data is stored in the storage portion 80. Hereinafter, with reference to FIG. 6 to FIG. 9, a description will be given of the test image G.

Figure 6:
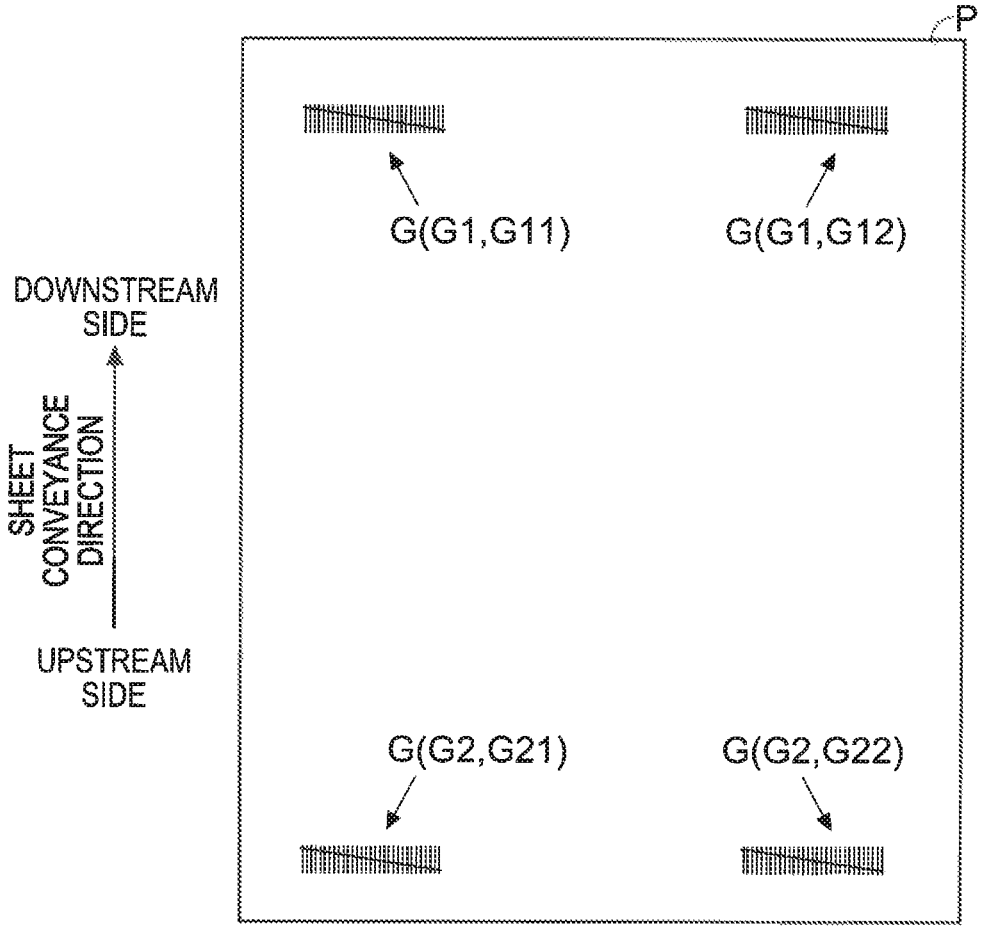
FIG. 6 is a diagram showing test images printed on a sheet by a printing portion of the inkjet printer according to the embodiment of the present disclosure.

The test image G, as shown in FIG. 6, includes a first test image G. which is printed on a leading end part (a downstream-side part) of the sheet P in the sheet conveyance direction. The test image G further includes a second test image G, which is printed on a rear end part (an upstream-side part) of the sheet P in the sheet conveyance direction. In the following description, when it is necessary to distinguish the first test image G from the second test image G, the first test image G will be denoted by "G1", and the second test image G will be denoted by "G2", The first test image G1 is printed one at each of two positions on the leading end part of the sheet P. The second test image G2 is printed one at each of two positions on the rear end part of the sheet P. Accordingly, a total of four test images G are printed. The four test images G are identical to each other in shape. In the following description, when it is necessary to distinguish the two first test images G1 from each other, the first test image G1 located on one side in the direction orthogonal to the sheet conveyance direction (hereinafter simply referred to as one side) will be denoted by "G11" and the other first test image G1 located on the other side opposite from the one side (hereinafter simply referred to as the other side) will be denoted by "G12". When it is necessary to distinguish the two second test images G2 from each other, the second test image G2 located on the one side will be denoted by "G21" and the second test image G2 located on the other side will be denoted by "G22".

The following description will focus on one of the four test images G, and its shape will be described in detail. Since the four test images G are identical to each other in shape, descriptions of the shapes of the other test images G will be omitted.

Figure 7:
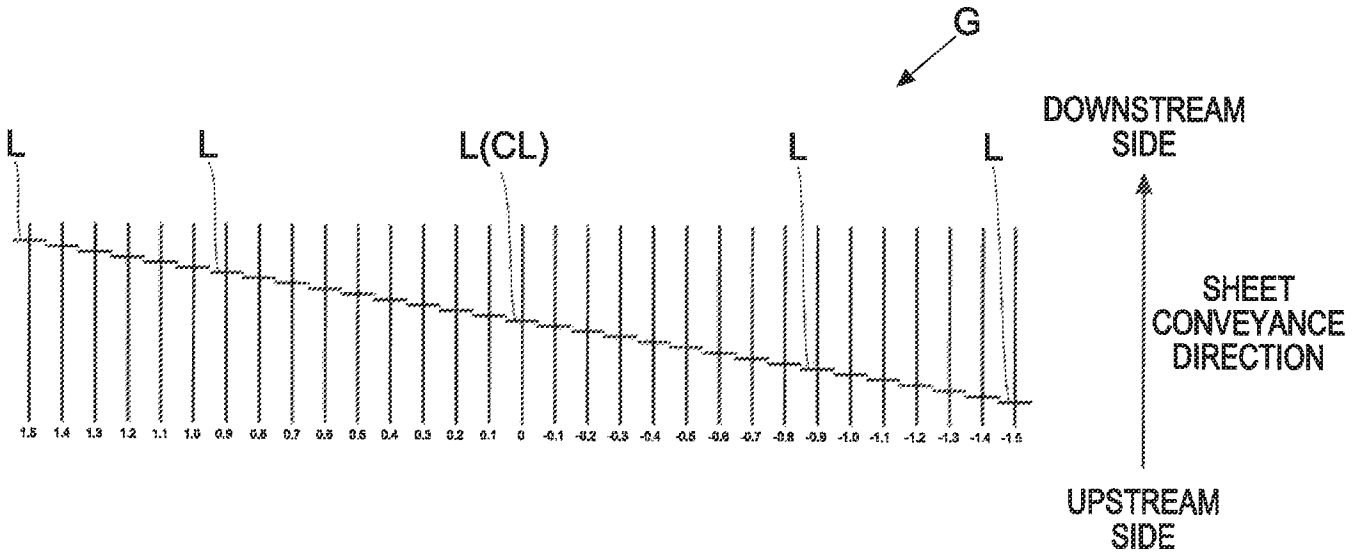
FIG. 7 is a detailed diagram of a test image shown in FIG. 6.

The test image G, as shown in FIG. 7, includes a plurality of lateral lines L orthogonal to the sheet conveyance direction. The number of the lateral lines L included in the test image G is 31. In FIG. 7, for the sake of convenience, only predetermined ones of the lateral lines are denoted by the sign "L". As to the other lateral lines, signs are omitted. The plurality of lateral lines L are arrayed at predetermined intervals in the sheet conveyance direction. The line width (the width in the sheet conveyance direction) of each of the plurality of lateral lines L is a two-dot width (about 0.085 mm). An interval (lateral line pitch) between two lateral lines L adjacent to each other in the sheet conveyance direction is a two-dot interval (about 0.085 mm) or a three-dot interval (about 0.127 mm).

Although not denoted by any reference sign, longitudinal lines extending in the sheet conveyance direction are drawn, each passing through the center of a corresponding lateral line L in the direction orthogonal to the sheet conveyance direction. An interval (a longitudinal-line pitch) between two longitudinal lines adjacent to each other in the direction orthogonal to the sheet conveyance direction is an interval of 2 mm. Of the plurality of lateral lines L, one at the one-side end is located more downstream-side than the other lateral lines L in the sheet conveyance direction, and one at the other-side end is located more upstream-side than the other lateral lines L in the sheet conveyance direction. The positions of the plurality of lateral lines L in the sheet conveyance direction are displaced from each other by two or three dots.

The plurality of lateral lines L are each marked with a scale value (the scale value indicating the position of the corresponding lateral line L in the sheet conveyance direction). The maximum scale value is "1.5", and the minimum scale value is "−1.5". The lateral line L at the end on the one side is marked with the maximum scale value, and the lateral line L at the end on the other side is marked with the minimum scale value. The plurality of lateral lines L are marked with scale values that decrement by 0.1 from the one side toward the other side.

One of the plurality of lateral lines L is a center line CL. The center line CL is marked with the scale value "0". Of the lateral lines L except the center line CL, that is, of the thirty lateral lines L, fifteen lateral lines L are arranged on the downstream side with respect to the center line CL in the sheet conveyance direction, and the other fifteen lateral lines L are arranged on the upstream side with respect to the center line CL in the sheet conveyance direction.

In the following description, when distinction is necessary, the lateral lines L of the first test image G1 will be denoted by "L1", and those of the second test image G2 will be denoted by "L2". The center line CL of the first test image G1 will be denoted by "CL1", and that of the second test image G2 will be denoted by "CL2". Further, those of the lateral lines L1 located on the downstream side with respect to the center line CL1 in the sheet conveyance direction will be denoted by "L11", and those located on the upstream side with respect to the center line CL1 in the sheet conveyance direction will be denoted by "L12". Those of the lateral lines L2 located on the downstream side with respect to the center line CL2 in the sheet conveyance direction will be denoted by "L21", and those located on the upstream side with respect to the center line CL2 in the sheet conveyance direction will be denoted by "L22".

Here, the lateral lines L1 correspond to "first line images", the center line CL1 corresponds to "a first center line image", the lateral lines L11 correspond to "first leading-end-side images", and the lateral lines L12 correspond to "first rear-end-side images". Here, the lateral lines L2 correspond to "second line images", the center line CL2 corresponds to "a second center line image", the lateral lines L21 correspond to "second leading-end-side images", and the lateral lines L22 correspond to "second rear-end-side images".

Figure 8:
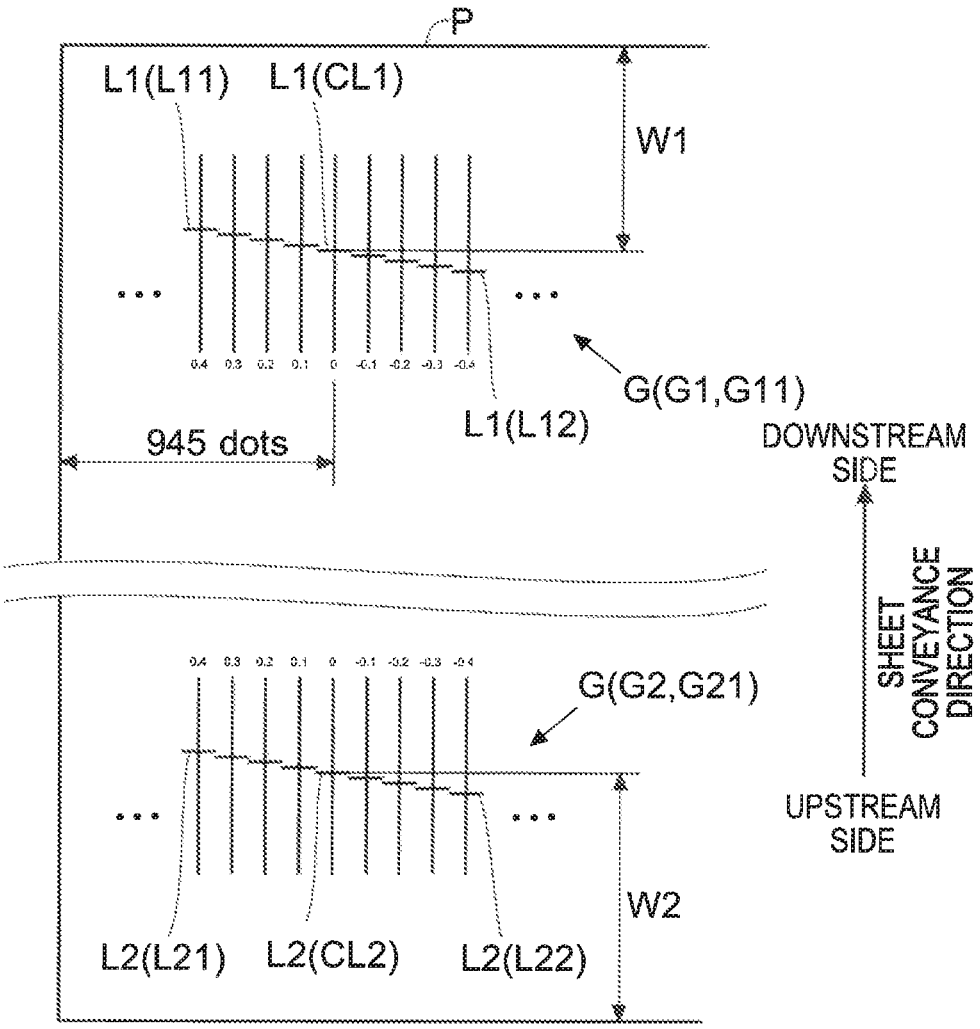
FIG. 8 is a diagram showing printing positions of the test images shown in FIG. 6.

As shown in FIG. 8. the position of the first test image G11 in the sheet conveyance direction is set such that the distance from the leading end of the sheet P to such one of a plurality of pixels constituting the center line CL1 as is on the downstream side in the sheet conveyance direction is a width W1. The width W1 is a 346-dot width (about 14.647 mm).

Although not shown, the position of the first test image G12 in the sheet conveyance direction is set in the same manner as that of the first test image G11. In FIG. 8, for the sake of convenience, part of the first test image G11 is omitted.

The position of the second test image G21 in the sheet conveyance direction is set such that the distance from the rear end of the sheet P to such one of a plurality of pixels constituting the center line CL2 as is on the upstream side in the sheet conveyance direction is a width W2. The width W2 is a 310-dot width (about 13.123 mm).

For example, in a case where the dimension of the sheet P in the sheet conveyance direction is 420 mm (equal to the dimension of the long side of an A3 sheet), the position of the second test image G21 in the sheet conveyance direction is set such that such one of a plurality of pixels constituting the corresponding center line CL2 as is located on the upstream side in the sheet conveyance direction is located at a 9611-dot distance (about 406.88 mm) from the leading end of the sheet P. Further, although not shown, in a case where the dimension of the sheet P in the sheet conveyance direction is 17 inches (equal to the dimension of the long side of a Ledger size sheet: about 432 mm (10205 dots)), the position of the second test image G21 in the sheet conveyance direction is set such that such one of the plurality of pixels constituting the corresponding center line CL2 as is located on the upstream side in the sheet conveyance direction is located at a 9895-dot distance from the leading end of the sheet P.

Although not shown, the position of the second test image G22 in the sheet conveyance direction is set in the same manner as that of the second test image G22. In FIG. 8, for the sake of convenience, part of the second test image G21 is omitted.

The position of the first test image G11 in the direction orthogonal to the sheet conveyance direction is set such that the center position of the center line CL1 (the position of the longitudinal line passing through the center position in the direction orthogonal to the sheet conveyance direction) is at a 945-dot distance (about 40 mm) from the end of the sheet P on the one side. Likewise, the position of the second test image G21 in the direction orthogonal to the sheet conveyance direction is set such that the center position of the center line CL2 (the position of the longitudinal line passing through the center position in the direction orthogonal to the sheet conveyance direction) is at a 945-dot distance from the end of the sheet P on the one side.

Figure 9:
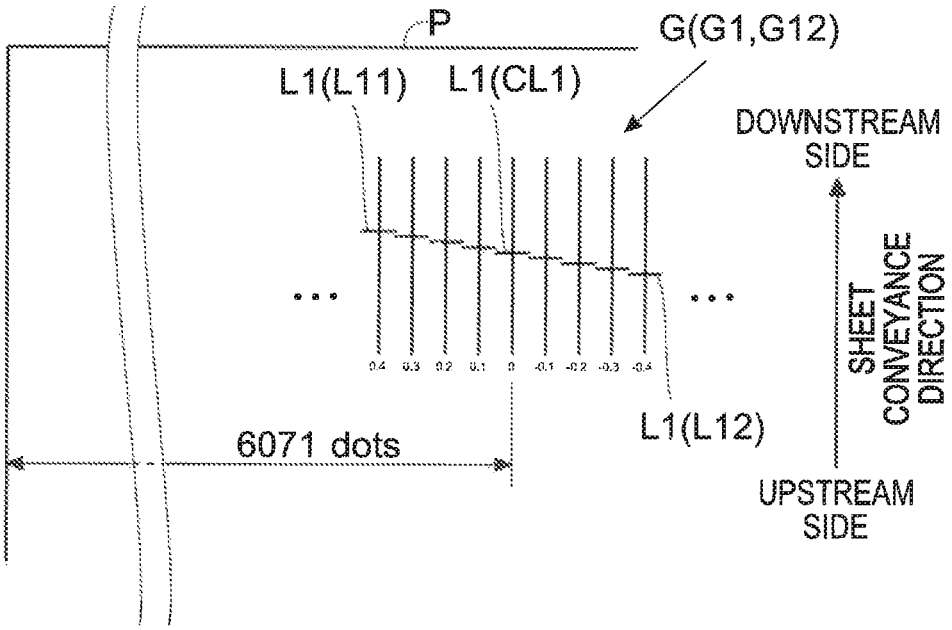
FIG. 9 is a diagram showing a printing position of a test image shown in FIG. 6.

The position of each of the first test image G12 and the second test image G22 in the direction orthogonal to the sheet conveyance direction depends on the dimension of the sheet P in the direction orthogonal to the sheet conveyance direction. For example, in a case where the dimension of the sheet P in the direction orthogonal to the sheet conveyance direction is 297 mm (equal to the length of the short side of an A3 sheet: 7016 dots), as shown in FIG. 9, the position of the first test image G12 in the direction orthogonal to the sheet conveyance direction is set such that the center position of the center line CL1 (the position of the longitudinal line passing through the center position in the direction orthogonal to the sheet conveyance direction) is at a 6071-dot distance from the end of the sheet P on the one side. Further, although not shown, in a case where the dimension of the sheet P in the sheet conveyance direction is 11 inches (equal to the dimension of the short side of a Ledger size sheet: about 279 mm (6591 dots)), the position of the first test image G12 in the direction orthogonal to the sheet conveyance direction is set such that the center position of the center line CL1 is at a 5646-dot distance from the end of the sheet P on the one side.

Although not shown, the position of the second test image G22 in the direction orthogonal to the sheet conveyance direction is set in the same manner as that of the first test image G12. In FIG. 9. for the sake of convenience, part of the first test image G12 is omitted.

Figure 10:
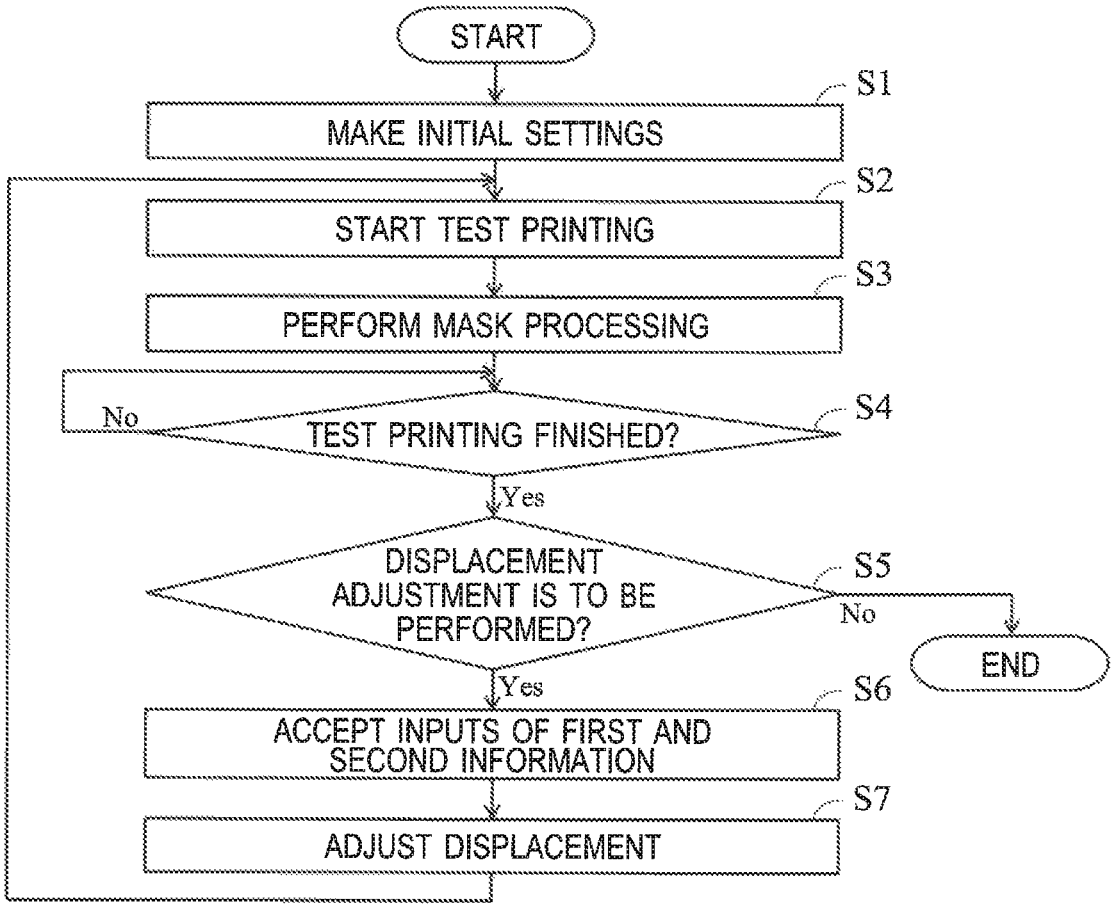
FIG. 10 is a flowchart showing a flow of a process performed by the control portion of the inkjet printer according to the embodiment of the present disclosure.

The control portion 60 performs processing along the flowchart shown in FIG. 10 to make the printing portion 30 perform printing (test printing) of the test image G as shown in FIG. 6 to FIG. 9 on the sheet P. The flow of the processing performed by the control portion 30 will be described below with reference to the flowchart shown in FIG. 10. The flowchart shown in FIG. 10 starts when an instruction to execute first test printing is accepted.

In step S1, the control portion 60 makes initial settings for the test printing. The initial settings include a setting necessary to generate the test mask data TM (see FIG. 11).

The initial settings made by the control portion 60 include the setting of the number of test offset lines (the number of dots). Here, the initial value of the number of the test offset lines is determined in advance, and is stored in the storage portion 80 in advance as the initial number of offset lines. In a first test printing, the initial number of the offset lines is used as the number of the test offset lines.

The initial settings made by the control portion 60 also include the setting of a test ratio. Here, the initial value of the test ratio is determined in advance and is stored as an initial ratio in the storage portion 80 in advance. In the first test printing, the initial ratio is used as the test ratio. Here, in the present embodiment, a 16-bit shift is performed. Accordingly, the control portion 60 recognizes, in making the initial settings, an initial incremental value determined in advance as the initial value of a test incremental value. The initial incremental value is stored in the storage portion 80 in advance. In the first test printing, the initial incremental value is used as the test incremental value.

In step S2, the control portion 60 instructs the conveyance portion 20 and the printing portion 30 to start test printing. The control portion 60 also makes the reading portion 40 start reading. After instructing the relevant portions to start test printing, the control portion 60 starts monitoring output values of the detection portion 50.

The conveyance portion 20, on receiving the instruction to start the test printing, feeds a sheet P into the sheet conveyance path 10 to convey the sheet P along the sheet conveyance path 10. Thereby, the leading end of the sheet P under conveyance reaches the detection position DR At this time, the detection portion 50 detects that the leading end of the sheet P under conveyance has reached the detection position DP, and feeds the control portion 60 with a signal indicating that the leading end of the sheet P under conveyance has reached the detection position DP.

Figure 11:
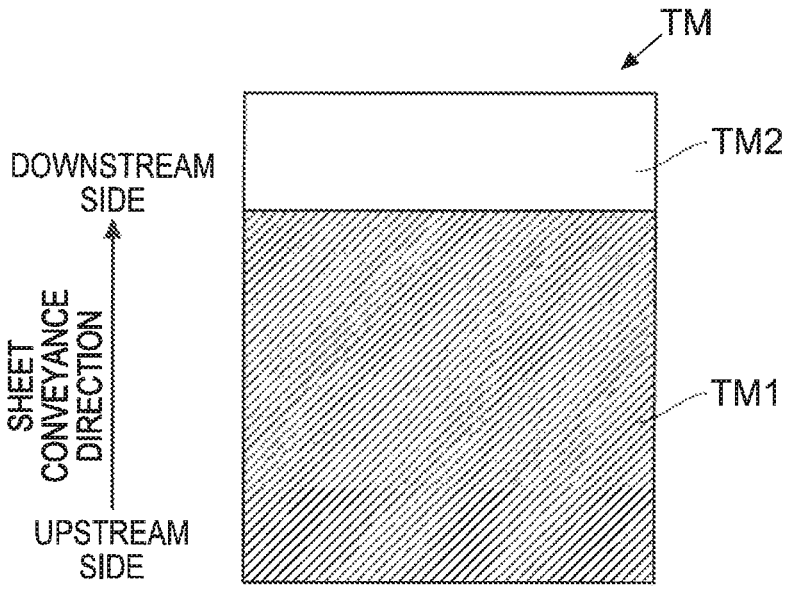
FIG. 11 is a diagram showing test mask data generated by the control portion of the inkjet printer according to the embodiment of the present disclosure.

In step S3, the control portion 60 generates test mask data TM based on data obtained by reading performed by the reading portion 40. Then, the control portion 60 performs the mask processing on the test image data based on the test mask data TM, A conceptual diagram of the test mask data TM is shown in FIG. 11. The control portion 60 sets a sheet read region TM1 of the test mask data TM as a non mask region, the sheet read region TM1 being a region obtained by reading the sheet P. The sheet read region TM1 is a region where ink ejection is allowed (a region where printing is allowed). On the other hand, outside the sheet read region TM1 is a mask region where ink ejection is prohibited (a region where printing is prohibited).

Here, the control portion 60, based on the initial number of the offset lines, extracts the test mask data TM from the read data obtained through the reading performed by the reading portion 40. Specifically, the control portion 60 sets, as the head line of the test mask data TM, such one of the plurality of read pixel lines in the read pixel data as is located at a position upstream of the detection-time line by the number of lines obtained by adding the initial number of the offset lines to the reference number of lines, the detection-time line being a pixel line read at the time of the detection portion 50 detecting the leading end of the sheet P under conveyance.

In this manner, in the test printing, the initial number of the offset lines is added to the reference number of lines. Accordingly, in the test mask data TM, in a downstream-side region thereof in the sheet conveyance direction, a leading-end mask region TM2 is added. The leading-end mask region TM2 exists outside the sheet read region TM1. That is, the leading-end mask region TM2 is a region to which no ink is allowed to be ejected.

The control portion 60 also performs the assignment processing based on the initial ratio (the initial incremental value). The assignment processing performed in test printing is identical to that performed in normal printing except that the ratio used in test printing is different from that used in the normal printing. The initial ratio is a ratio that is larger than the reference ratio, That is, when performing the assignment processing based on the initial ratio, the control portion 60, with respect to each of the plurality of print pixel lines in the test image data, finds the integer part of a value obtained by multiplying the corresponding print pixel line number value by the initial ratio. Then, the control portion 60, with respect to each of the plurality of print pixel lines of the test image data, assigns a read pixel line having a read pixel line number value of the same value as the obtained integer part.

Here, also in the assignment processing based on the initial ratio, as in the assignment processing based on the reference ratio, a 16-bit shift is performed. Thus, the control portion 60 sequentially counts the plurality of print pixel lines of the test image data, and based on the initial incremental value, increments a count value (multiplies each print pixel line number value by the initial incremental value). The initial incremental value is determined in advance based on a value calculated by multiplying 65536 ($2^{16}$) by the initial ratio. Further, the control portion 60, each time it increments a count value, calculates a value by dividing the count value by $2^{16}$, and extracts the integer part of the thus calculated value. Each time it increments a count value, the control portion 60 stores, in the storage portion 80, the print pixel line number value of the print pixel line that is the target of the counting performed at that time and the integer part extracted at that time in correspondence with each other. The control portion 60, with respect to each of the plurality of print pixel lines of the print image data, assigns a read pixel line having a read pixel line number value of the same value as the obtained integer part.

Then, the control portion 60 performs, as the mask processing, with respect to each of the plurality of print pixel lines of the test image data, processing of replacing, with white pixels, pixels located outside a region corresponding to the sheet read region TM1 of the assigned read pixel line. The control portion 60, on a line-to-line basis, feeds the printing portion 30 (the driver 33) with an ejection control signal corresponding to the print pixel line having undergone the mask processing.

Here, the initial number of the offset lines and the initial incremental value (the initial ratio) are determined in advance such that none of the lateral lines L11 is printed and the center line CL1 and all of the lateral lines L12 are printed. Also, the initial number of the offset lines and the initial incremental value (the initial ratio) are determined in advance such that none of the lateral lines L22 is printed and the center line CL2 and all of the lateral lines L21 are printed.

Figure 12:
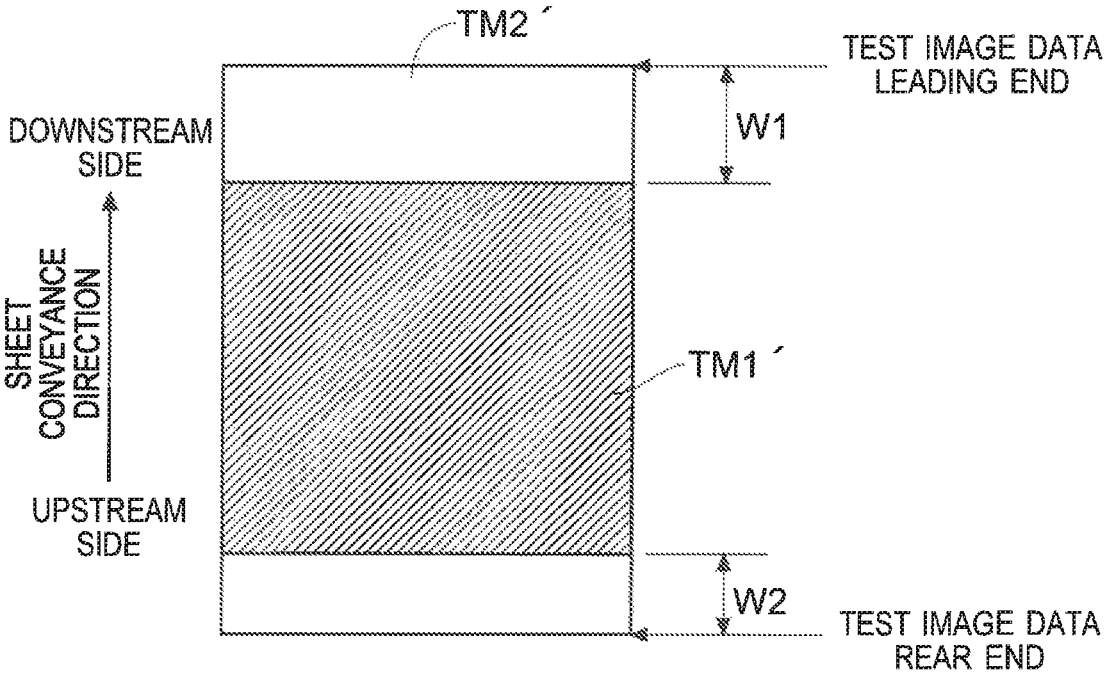
FIG. 12 is a diagram showing, on image data used for test printing performed by the inkjet printer according to the embodiment of the present disclosure, a position of a region corresponding to a sheet read region (non-mask region) of the test mask data.

Specifically, as shown in FIG. 12, the initial number of the offset lines is set such that the width W1 is the width between the leading end of the test image data in the sheet conveyance direction and the leading end of a region TM1' of the test image data in the sheet conveyance direction, the region TM1' corresponding to the sheet read region TM1 (a non mask region) of the test mask data TM. That is, the initial number of the offset lines is set such that the width W1 is the width of a region TM2' of the test image data in the sheet conveyance direction, the region TM2' corresponding to the leading-end mask region TM2 of the test mask data TM. A value calculated by using later-described formula (3) when the value of A is zero (for example, a value obtained by rounding off the first decimal place of the thus obtained value) is set as the initial number of the offset lines.

The initial incremental value (the initial ratio) is set such that the width W2 is the width, in the sheet conveyance direction, between the rear end of the region TM1' of the test image data in the sheet conveyance direction and the rear end of the test image data in the sheet conveyance direction. A value calculated by using later-described formula (5) when the value of C is zero (for example, a value obtained by rounding off the first decimal place of the thus obtained value) is set as the initial incremental value. Here, the initial ratio can be calculated by using later-described formula (5) by replacing the reference incremental value CU with the reference ratio.

Figure 13:
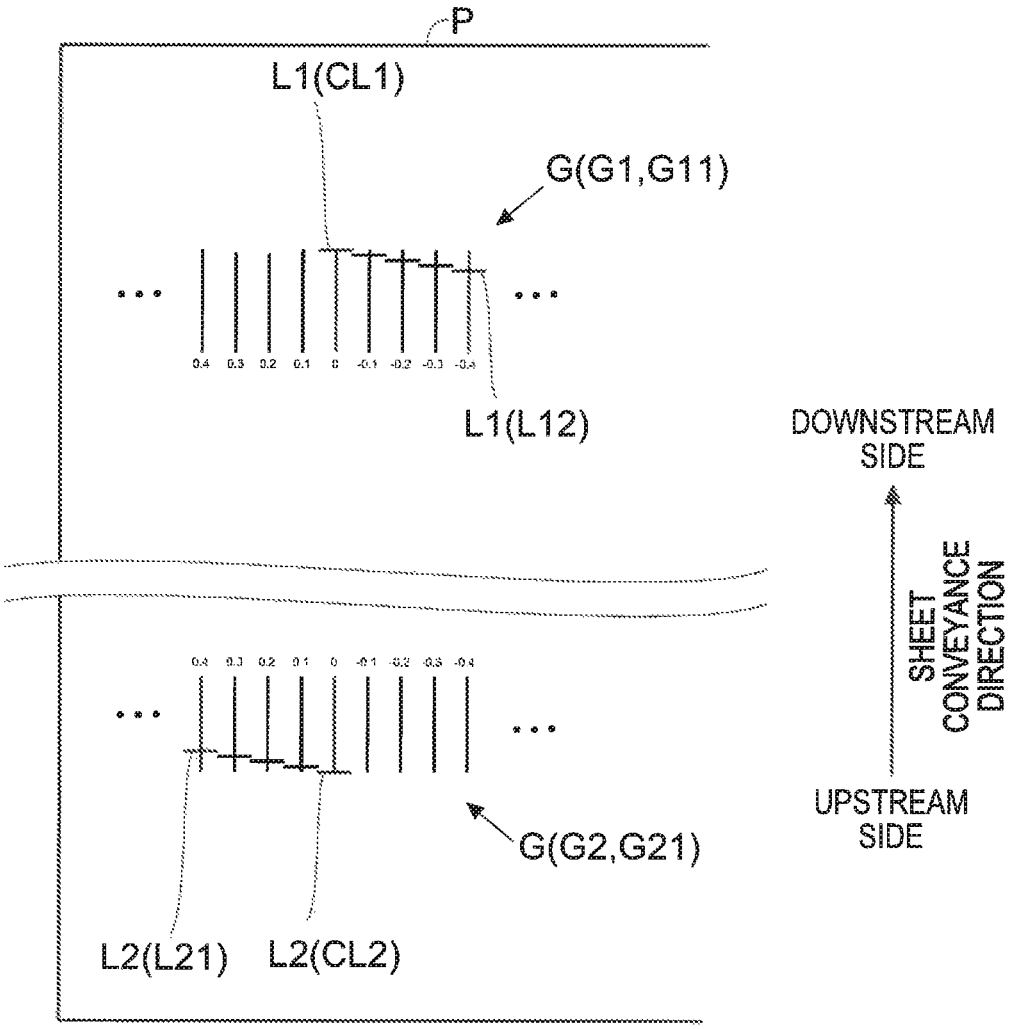
FIG. 13 is a diagram showing an example of an output result of the test printing performed by the inkjet printer according to the embodiment of the present disclosure.

An ideal output result in the test printing is shown in FIG. 13. In FIG. 13, for the sake of convenience, only part of the first test image G11 and part of the second test image G21 are illustrated. Here, it is assumed that the output result of the first test image G12 is identical to that of the first test image G11. It is also assumed that the output result of the second test image G22 is identical to that of the second test image G21.

Referring back to FIG. 10, in step S4, the control portion 60 judges whether or not the test printing has been finished. In a case where the control portion 60 has judged that the test printing has not been finished yet, the judgement performed in step S4 is repeated. In a case where the control portion 60 has judged that the test printing has been finished, the flow proceeds to step S5.

In step S5, the control portion 60 makes the operation panel 70 accept setting of whether or not to perform adjustment. The adjusting person checks the output result of the test printing after the test printing is finished, and if the adjusting person judges that adjustment is necessary, he or she operates the operation panel 70 to make a request for adjustment. When, in step S5, the control portion 60 judges that a request for adjustment has been accepted, the flow proceeds to step S6.

In step S6, the control portion 60 makes the operation panel 70 accept inputs of first information and second information. The operation panel 70 displays an unillustrated input screen to accept the first information and the second information from the adjusting person.

Figure 14:
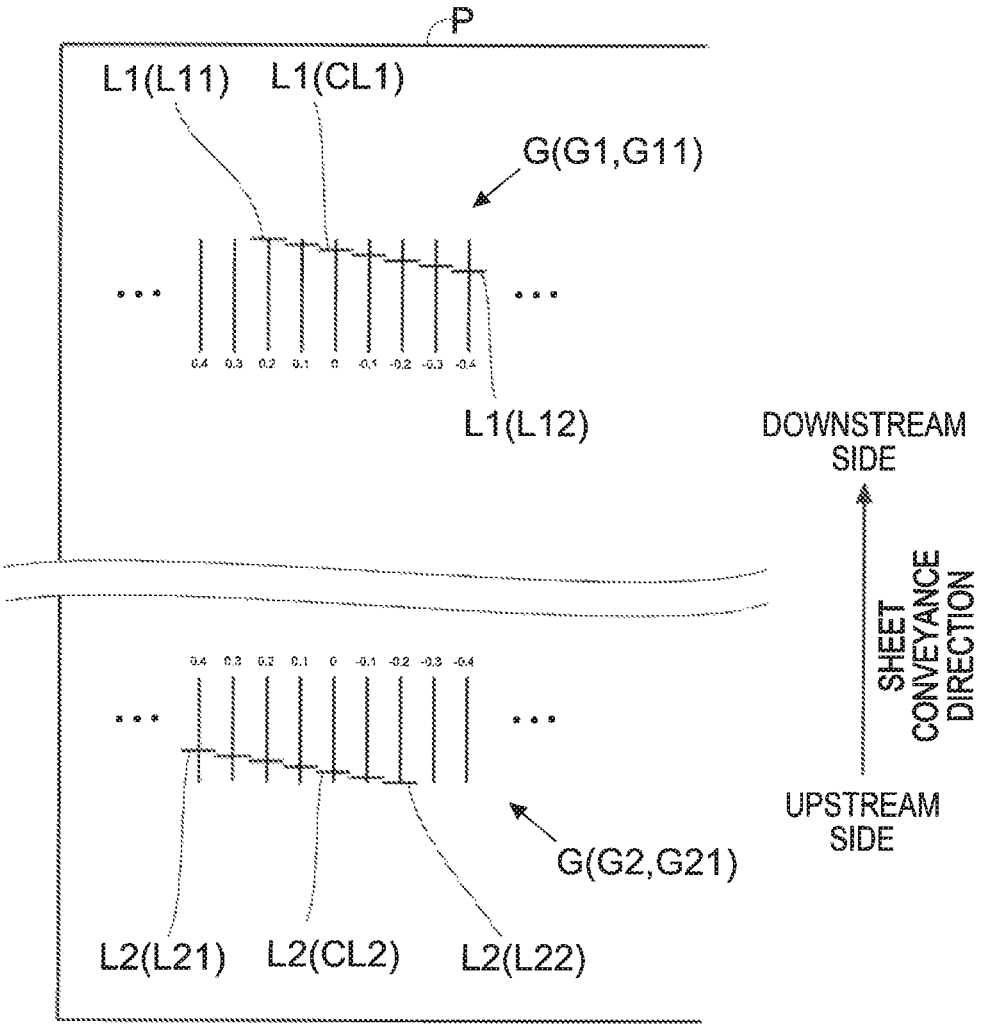
FIG. 14 is a diagram showing an example of an output result of the test printing performed by the inkjet printer according to the embodiment of the present disclosure.

For example, adjustment is performed in a case where such an output result as shown in FIG. 14 has been obtained. In FIG. 14, for the sake of convenience, only part of the first test image G11 and part of the second test image G21 are illustrated. Here, it is assumed that the output result of the first test image G12 is identical to that of the first test image G11. It is also assumed that the output result of the second test image G22 is identical to that of the second test image G21.

FIG. 14 shows an example where, of the plurality of lateral lines L1 of the first test image G1, the lateral line L1 marked with "0.2" is printed. No lateral line L1 on the downstream side of the lateral line L1 marked with "0.2" in the sheet conveyance direction is printed, but those on the upstream side of the lateral line L1 marked with "0.2" are all printed.

Further, in the example, of the plurality of lateral lines L2 of the second test image G2, the lateral line L2 marked with "−0.2" is printed. No lateral line L2 on the downstream side of the lateral line L2 marked with "−0.2" in the sheet conveyance direction is printed, but those on the upstream side of the lateral line L2 marked with "−0.2" are all printed.

In a case where, in the state shown in FIG. 14, normal printing, which is not test printing, is performed, on the image data to be used for printing, the position of a region corresponding to the sheet read region M1 of the mask data M will be displaced in the sheet conveyance direction. Thus, adjustment is necessary such that the position of the region, on the image data to be used for printing, corresponding to the sheet read region M1 of the mask data M will not be displaced in the sheet conveyance direction.

Here, the positional relationship in the sheet conveyance direction between the center line CL and the region TM1' of the test image data corresponding to the sheet read region TM1 of the test mask data TM is in accordance with a displacement amount of such a region of the image data to be used for normal printing as corresponds to the sheet read region M1 of the mask data M in the sheet conveyance direction. Thus, acceptance of inputs of the first information and the second information is performed.

The adjusting person inputs, as the first information, the scale value corresponding to such one of the plurality of lateral lines L1 in each of the two first test images G1 (G11 and G12) as is printed on the most downstream side in the sheet conveyance direction. In the example shown in FIG. 14, as the first information corresponding to the first test image G11, the scale value "0.2" is inputted. As the first information corresponding to the first test image G12, the scale value "0.2" is inputted.

The adjusting person inputs, as the second information, the scale value corresponding to such one of the plurality of lateral lines L2 in each of the two second test images G2 (G21 and G22) as is printed on the most upstream side in the sheet conveyance direction. In the example shown in FIG. 14, as the second information corresponding to the second test image G12, the scale value "−0.2" is inputted. As the second information corresponding to the second test image G22, the scale value of "−0.2" is inputted.

Referring back to FIG. 10, in step S7, based on the first information and the second information, the control portion 60 adjusts the number of the test offset lines (the number of the dots), and also adjusts the incremental value (the test ratio) to be used for the assignment processing. At this time, based on the first information and the second information, the control portion 60 recognizes the displacement amount of the region TM1' of the test image data, the region TM1' corresponding to the sheet read region TM1 of the test mask data TM.

The control portion 60 refers to adjustment information. The adjustment information is stored in the storage portion 80 in advance. In the adjustment information, as shown in FIG. 15, interval values indicating intervals between the center line CL and the lateral lines L are defined. The interval values corresponding to such ones of the lateral lines L as are located on the downstream side with respect to the center line CL in the sheet conveyance direction are positive values, and the interval values corresponding to such ones of the lateral lines L as are located on the upstream side with respect to the center line CL in the sheet conveyance direction are negative values.

For example, the interval (lateral line pitch) between the lateral line L marked with the scale value "0.1" and the center line CL is a two-dot interval (about 0.085 mm), and thus the interval value corresponding to the scale value "0.1" is set to "two dots (0.085 mm)". The interval (lateral line pitch) between the lateral line L marked with the scale value "0.1" and the lateral line L marked with the scale value "0.2" is a three-dot interval, and thus, the interval value corresponding to the scale value "0.2" is set to "five dots (0.212 mm)". Since the interval (lateral line pitch) between the lateral line L marked with the scale value "−0.1" and the center line CL is a two-dot interval and the lateral line L marked with the scale value "−0.1" is located on the upstream side in the sheet conveyance direction with respect to the center line CL, the interval value corresponding to the scale value "−0.1" is set to "−2 dots (−0.085 mm)".

The control portion 60, based on the adjustment information, recognizes the interval values corresponding the first information and the second information inputted on the operation panel 70.

Then, the control portion 60, based on formula (1) below, recognizes a leading-end displacement amount A, which is the amount of displacement between the leading end of the region TM1' of the test image data on the downstream side in the sheet conveyance direction and the center line CL1 (a value indicating by how many dots the leading end is displaced from the center line).

$$A=A'+(A1+A2)/2 \quad (1)$$

In formula (1), A1 and A2 represent interval values corresponding to the first information having been inputted after the execution of this test printing. A1 represents the interval value corresponding to the first test image G11. A2 represents the interval value corresponding to the first test image G12. In the example shown in FIG. 14, the value of A1 is "5 (dots)". The value of A2 is "5 (dots)". The value of A' is the leading-end displacement amount A obtained after the execution of the previous test printing. In a case where this test printing is the first test printing, the value of A is "0".

Then, the control portion 60, based on formula (2) below, recognizes a rear-end displacement amount B, which is the amount of displacement between the rear end of the region TM1' of the test image data on the upstream side in the sheet conveyance direction and the center line CL2 (a value indicating by how many dots the rear end is displaced from the center line).

$$B=B'+(B1+B2)/2 \quad (2)$$

In formula (2), B1 and B2 represent interval values corresponding to the second information having been inputted after the execution of this test printing. B1 represents the interval value corresponding to the second test image G21. B2 represents the interval value corresponding to the second test image G22. In the example shown in FIG. 14, the value of B1 is "−5 (dots)". The value of B2 is "−5 (dots)". The value of B' is the rear-end displacement amount B having been obtained after the execution of the previous test printing. In the case where this test printing is the first test printing, the value of B' is "0".

The control portion 60, based on formula (3) below, calculates the number of the test offset lines. The control portion 60 uses a value calculated by using formula (3) (for example, a value obtained by rounding off the first decimal place of the thus obtained value) as the adjusted number of the test offset lines.

$$\text{Number of Test Offset Lines}=(W1+A\times Pd)/Pd\times Ra \quad (3)$$

In formula (3), W1 represents the width W1 (mm) shown in FIG. 8. The value A is calculated by using formula (1). Pd represents the width of one dot (one line) under the printing resolution of the printing portion 30. Ra represents the ratio of the width of one dot (one line) under the printing resolution of the printing portion 30 to the width of one dot (one line) under the reading resolution of the reading portion 40.

The control portion 60 calculates an adjusted test incremental value. First, the control portion 60 obtains an adjustment value C (mm) by using formula (4) below.

$$C=(B-A)\times Pd \quad (4)$$

In formula (4), A represents a value calculated by using formula (1). B represents a value calculated by using formula (2). Pd represents the width of one dot (one line) of the printing resolution of the printing portion 30.

The control portion 60, based on formula (5) below, calculates the test incremental value. The control portion 60 uses a value calculated by using formula (3) (for example, a value obtained by rounding off the first decimal place of the thus calculated value) as the adjusted test incremental value. Here, the adjusted test ratio can be calculated by using later-described formula (5) by replacing the reference incremental value CU with the reference ratio.

$$\text{Test Incremental Value}=\{S/(S-W1-W2+C)\}\times CU \quad (5)$$

In formula (5), S represents the dimension (mm) of a sheet P in the sheet conveyance direction. W1 represents the width W1 (mm) shown in FIG. 8. W2 represents the width W2 (mm) shown in FIG. 8. C represents an adjustment value (mm) calculated by using formula (4). CU represents the reference incremental value.

After the processing in step S7, the flow returns to step S2. That is, the control portion 60 makes the printing portion 30 perform test printing again.

At this time, the control portion 60, based on the adjusted number of the test offset lines, sets the head line of the test mask data TM. The control portion 60 performs the assignment processing based on the adjusted test incremental value (the test ratio).

Thereafter, the flow proceeds to step S3. In step S3, the control portion 60, based on the adjusted test mask data TM, performs the mask processing on the test image data. In the mask processing performed at this time, the adjustment having been made based on the output result of the previous test printing is reflected. Accordingly, the output of the previous test printing is different from that of this test printing.

After the test printing performed again is finished, the flow proceeds to step S5. The adjusting person checks a newly outputted printed matter. In a case where, as a result, it is judged that another displacement adjustment is necessary, the adjusting person gives an instruction to execute displacement adjustment (Yes in step S5). The adjusting person performs the same checking that he or she has performed after the execution of the previous test printing with respect to the output result of the repeated test printing, and inputs the first information and the second information again (step S6).

Then, in step S7, the control portion 60, based on the first information and the second information inputted again, adjusts the number of the test offset lines (the number of dots) again, and adjusts the test incremental value (the test ratio) to be used in the assignment processing.

At this time, in formula (1), the leading-end displacement value A calculated after the execution of the previous test printing is substituted for A'. The interval values corresponding to the first information inputted by the adjusting person after the execution of this test printing (the test printing performed again) are respectively substituted for A1 and A2.

In formula (2), the rear-end displacement value B calculated after the execution of the previous test printing is substituted for B'. The interval values corresponding to the second information inputted by the adjusting person after the execution of this test printing (the test printing performed again) are respectively substituted for B1 and B2.

The control portion 60, after the readjustment, makes the printing portion 30 perform test printing again. The control portion 60, based on the readjusted number of the test offset lines, sets the head line of the test mask data TM. The control portion 60 performs the assignment processing based on the readjusted test incremental value (the test ratio). The adjusting person repeatedly makes the inkjet printer 100 perform test printing until a printed matter is outputted in which none of the lateral lines L11 is printed, the center line CL1 and the lateral lines L12 are all printed, none of the lateral lines L22 is printed, and the center line CL2 and the lateral lines L21 are all printed.

In a case where, in step S5, the control portion 60 judges that an instruction has been accepted not to perform the displacement adjustment, the present flow ends.

After the adjustment made based on the output result of test printing, when the control portion makes the printing portion 30 perform normal printing, the control portion 60 has the result of the adjustment reflected in the normal printing.

The control portion 60, based on the result of the adjustment, in setting the head line of the mask data M, performs correction on the number of lines (the number of dots) by which the leading line should be upstream of a detection-time line in the sheet conveyance direction. That is, the control portion 60 calculates a number of correction lines. The control portion 60 uses a value calculated by using formula (6) below (for example, a value obtained by rounding off the first decimal place of the thus calculated value) as the number of the correction lines.

$$\text{Number of Correction Lines}=LN+NA\times Ra \quad (6)$$

In formula (6), LN represents the number of the reference lines (the number of dots). NA represents the leading-end displacement amount A (a value indicating by how many dots the leading end is displaced) calculated based on the interval values corresponding to the first information inputted after the execution of the last test printing. That is, NA represents the latest value of A calculated based on formula (1). Ra represents the ratio of the one-dot width under the printing resolution of the printing portion 30 to the one-dot width under the reading resolution of the reading portion 40.

The control portion 60, based on the result of the adjustment, corrects the incremental value to be used in the assignment processing. That is, the control portion 60 calculates a corrected incremental value. The control portion 60 uses a value calculated by using formula (7) below (for example, a value obtained by rounding off the first decimal place of the thus calculated value) as the corrected incremental value.

$$\text{Corrected incremental Value}=\{S/(S-Ma1-Ma2+NC)\}\times CU \quad (7)$$

In formula (7), S represents the dimension (mm) of a sheet P in the sheet conveyance direction. NC represents the newest value of C calculated based on formula (4). CU represents the reference incremental value.

In normal-mode printing, "0" is substituted for each of Ma1 and Ma2. In special-mode printing, a predetermined value is substituted for each of Ma1 and Ma2. The predetermined value is 0.12193 (mm), for example. In the special-mode printing, a margin of a width equivalent to the predetermined value is inserted in the leading end part of a sheet P, and a margin of a width equivalent to the predetermined value is inserted in the rear end part of the sheet P.

With the configuration of the present embodiment, as described above, test printing can be performed. In the test printing, an image (an image in which part of each test images G is omitted) is printed, the image indicating the amount of displacement, in the sheet conveyance direction, of such a region of the image data to be used for normal printing (printing that is not test printing) as corresponds to the sheet read region M1 (a non mask region) of the mask data M. This allows the adjusting person to easily recognize the amount of displacement, in the sheet conveyance direction, of the region of the image data corresponding to the sheet read region M1 of the mask data M. In the example shown in FIG. 14, it is recognized that the sheet-conveyance-direction leading end of the region of the image data corresponding to the sheet read region M1 of the mask data M is displaced toward the downstream side in the sheet conveyance direction by five dots (the interval value corresponding to the scale value "0.2"). It is also recognized that the sheet-conveyance-direction rear end of the region of the image data corresponding to the sheet read region M1 (a non mask region) of the mask data M is displaced toward the upstream side in the sheet conveyance direction by five dots (the interval value corresponding to the scale value "−0.2").

This makes it possible to adjust, based on the result of the test printing, the position of such a region of the image data as corresponds to the sheet read region M1 of the mask data M in the sheet conveyance direction. That is, even if the positional relationship between the printing position PP and the reading position RP in the sheet conveyance direction is displaced from a set value or even if the ratio (the ratio to be used in the assignment processing) of the one-dot with under the printing resolution of the printing portion 30 to the one-dot width under the reading resolution of the reading portion 40 is slightly displaced, it is possible in normal printing to reduce displacement of the position of the region of the image data corresponding to the sheet read region M1 of the mask data M in the sheet conveyance direction.

In the present embodiment, as described above, the test images G as shown in FIG. 6 to FIG. 9 are printed in test printing. Different lateral lines L are printed depending on the amount of displacement, in the sheet conveyance direction, of the position of such a region of the image data as corresponds to the sheet reading region M1 of the mask data M. Thereby, it is possible, by checking which lateral lines of each test image G are printed, to easily recognize the amount of displacement, in the sheet conveyance direction, of a region of the image data corresponding to the sheet read region M1 of the mask data M.

In the present embodiment, as described above, after the execution of test printing, the operation panel 70 accepts inputs of the first and second information from the adjusting person. This makes it possible to make the control portion 60 recognize the amount of displacement, in the sheet conveyance direction, of a region of the image data corresponding to the sheet read region M1 of the mask data M. Based on the inputted first and second information, the control portion 60 can adjust the displacement, in the sheet conveyance direction, of the position of such a region of the image data as corresponds to the sheet read region M1 of the mask data M.

In the present embodiment, as described above, it is possible to make the inkjet printer 100 continue to perform test printing until a printed matter is outputted in which none of the lateral lines L11 is printed, the center line CL1 and the lateral lines L12 are all printed, none of the lateral lines L22 is printed, and the center line CL2 and the lateral lines L21 are all printed, that is, until the displacement is eliminated.

It should be understood that the embodiments disclosed herein are merely illustrative in all respects, and should not be interpreted restrictively. The range of the present disclosure is shown not by the above descriptions of embodiments but the scope of claims for patent, and it is intended that all modifications within the meaning and range equivalent to the scope of claims for patent are included.

What is claimed is:

1. An image forming apparatus comprising:

a printing portion which performs printing on a sheet under conveyance on a one-by-one basis of lines orthogonal to a sheet conveyance direction;

a reading portion which reads, at a reading position on an upstream side of a printing position of the printing portion in the sheet conveyance direction, the sheet under conveyance on a one-by-one basis of lines orthogonal to the sheet conveyance direction, a detection portion which detects a leading end of the sheet under conveyance at a detection position between the printing position and the reading position;

a control portion which controls the printing portion; and a storage portion which stores therein a reference number of lines, which is a number of lines to be read in accordance with a design distance between the reading position and the detection position in the sheet conveyance direction, wherein the storage portion stores therein an initial number of offset lines, which is a number of lines to be read determined in advance as an initial value of a number of test offset lines, and when making the printing portion perform test printing based on test image data including a test image, the control portion sets, as a head line of test mask data, such a read pixel line of a plurality of read pixel lines of read data obtained by the reading portion by performing reading, the plurality of read pixel lines being orthogonal to the sheet conveyance direction, as is located at a position upstream of a detection-time line, the detection-time line being such a read pixel line of the plurality of read pixel lines as is read at a time at which the detection portion detects a leading end of the sheet, by a number of lines calculated by adding the initial number of offset lines to the reference number of lines, sets, as a non mask region, a sheet read region of the test mask data, the sheet read region being obtained by reading the sheet, and performs mask processing with respect to the test image data based on the test mask data to thereby replace, with white pixels, pixels outside such a region of the test image data as corresponds to the non mask region of the test mask data.

2. The image forming apparatus according to claim 1, wherein the storage portion stores therein, as a reference ratio, a ratio of a one-dot width under printing resolution of the printing portion to a one-dot width under reading resolution of the reading portion, and also stores therein an initial ratio which is determined in advance as an initial value of a test ratio, the initial ratio is a ratio that is larger than the reference ratio, and the control portion recognizes, with respect to each read pixel line of the plurality of read pixel lines, a read pixel line number value indicating what number line the each read pixel line is from the head line, recognizes, with respect to each print pixel line of a plurality of print pixel lines of the test image data, the plurality of print pixel lines being orthogonal to the sheet conveyance direction, a print pixel line number value indicating what number line the each print pixel line is from a head print pixel line of the plurality of print pixel lines in the sheet conveyance direction, obtains an integer part of a value calculated by multiplying the print pixel line number value by the initial ratio, assigns, to the each print pixel line of the plurality of print pixel lines, such a read pixel line of the plurality of read pixel lines as has the read pixel line number of a same value as the integer part obtained with respect to the each print pixel line, and performs, as the mask processing, processing of replacing, with a white pixel, such a pixel of the each print pixel line of the plurality of print pixel lines as is located outside a region corresponding to the non mask region of the read pixel line assigned to the each print pixel line.

3. The image forming apparatus according to claim 2, wherein the test image includes a first test image printed on a leading end part of the sheet, the first test image includes a plurality of first line images orthogonal to the sheet conveyance direction, the plurality of first line images are arrayed at predetermined intervals in the sheet conveyance direction, one of the plurality of first line images is a first center line image, the plurality of first line images, except for the first center line image, are classified into first leading-end-side images printed on a downstream side of the first center line image in the sheet conveyance direction, and first rear-end-side images printed on an upstream side of the first center line image in the sheet conveyance direction, and the initial number of offset lines and the initial ratio are determined in advance such that none of the first leading-end-side images is to be printed and the first center line image and all of the first rear-end-side images are to be printed.

4. The image forming apparatus according to claim 3, wherein the test image includes a second test image printed on a rear end part of the sheet, the second test image includes a plurality of second line images orthogonal to the sheet conveyance direction, the plurality of second line images are arrayed at predetermined intervals in the sheet conveyance direction, one of the plurality of second line images is a second center line image, the plurality of second line images, except for the second center line image, are classified into second leading-end-side images printed on a downstream side of the second center line image in the sheet conveyance direction, and second rear-end-side images printed on an upstream side of the second center line image in the sheet conveyance direction, and the initial number of offset lines and the initial ratio are determined in advance such that none of the second rear-end-side images is to be printed and the second center line image and all of the second leading-end-side images are to be printed.

5. The image forming apparatus according to claim 4, further comprising an operation panel, wherein the operation panel, after executing the test printing, accepts an input of first information indicating a position, in the sheet conveyance direction, of such a first line image of the plurality of first line images printed on the sheet as is printed on a most downstream side in the sheet conveyance direction, and an input of second information indicating a position, in the sheet conveyance direction, of such a second line image of the plurality of second line images printed on the sheet as is printed on a most upstream side in the sheet conveyance direction.

6. The image forming apparatus according to claim 5, wherein when making the printing portion perform the test printing again after acceptance, by the operation panel, of the input of the first information and the input of the second information, the control portion adjusts the number of test offset lines and the test ratio based on the first information and the second information such that none of the first leading-end-side images is to be printed, the first center line image and all of the first rear-end-side images are to be printed, none of the second rear-end-side images is to be printed, and the second center line image and all of the second leading-end-side images are to be printed.

* * * * *